US006386996B1

(12) United States Patent
Foster

(10) Patent No.: US 6,386,996 B1
(45) Date of Patent: May 14, 2002

(54) STRIDE ANALYZER AND TRAINER

(76) Inventor: Jeanna M. Foster, 2243 Benson Shady Grove Ave., Jesup, IA (US) 50648-9441

( * ) Notice: Subject to any disclaimer, the term of this patent is extended or adjusted under 35 U.S.C. 154(b) by 0 days.

(21) Appl. No.: 09/562,882

(22) Filed: May 1, 2000

(51) Int. Cl.[7] ..... A63B 69/00

(52) U.S. Cl. ..... 473/452; 473/278; 473/422; 434/252

(58) Field of Search ..... 473/415–422, 473/257, 258, 266, 270–273, 278, 452, 497, 218, 279; 434/252

(56) References Cited

U.S. PATENT DOCUMENTS

| | | | | | |
|---|---|---|---|---|---|
| 3,542,369 | A | * | 11/1970 | Anderson | 473/278 |
| 3,979,116 | A | * | 9/1976 | Matchick | 473/452 |
| 4,101,130 | A | | 7/1978 | Richards | |
| 4,194,735 | A | | 3/1980 | Wilson | |
| 4,248,431 | A | | 2/1981 | Burnes | |
| 4,434,983 | A | * | 3/1984 | Taggart | 473/273 |
| 4,544,161 | A | | 10/1985 | Guendling, Jr. | |
| 4,805,913 | A | | 2/1989 | Bott | |
| 4,915,387 | A | | 4/1990 | Baxstrom | |
| 4,932,656 | A | * | 6/1990 | Pierce | 473/452 |
| 5,000,449 | A | | 3/1991 | Weeks | |
| 5,037,094 | A | * | 8/1991 | Johnson | 473/452 |
| 5,042,815 | A | | 8/1991 | Sutton | |
| 5,071,130 | A | | 12/1991 | Shofner | |
| 5,139,263 | A | * | 8/1992 | Feo | 473/257 |
| 5,306,011 | A | * | 4/1994 | Perry | 473/218 |
| 5,330,176 | A | | 7/1994 | Cagney, Jr. | |
| 5,385,343 | A | * | 1/1995 | Davis, Sr. | 473/452 |
| 5,536,004 | A | | 7/1996 | Wiseman et al. | |
| 5,566,935 | A | * | 10/1996 | Meharg | 473/454 |
| 5,590,882 | A | * | 1/1997 | Todd | 473/218 |
| 5,645,494 | A | | 7/1997 | Dionne et al. | |
| 5,910,053 | A | | 6/1999 | Scalise | |
| 5,976,026 | A | | 11/1999 | Erb | |
| 6,050,902 | A | * | 8/2000 | McCrink, Jr. | 473/279 |
| 6,102,818 | A | * | 8/2000 | Hamilton | 473/452 |

OTHER PUBLICATIONS

"The Effect of Stride Angle on Ball Velocity and Stride Length in Softball Pitching" by Jeanna Marie Foster.

* cited by examiner

*Primary Examiner*—Paul T. Sewell
*Assistant Examiner*—Mitra Aryanpour
(74) *Attorney, Agent, or Firm*—James C. Nemmers

(57) ABSTRACT

An analyzer and practice aid primarily for determining a ball pitcher's or hitter's stride angle and stride length. The analyzer is comprised of a ground or floor mat with a grid imprinted on it, the grid havings a reference point from which reference lines extend forwardly and outwardly at predetermined angles toward a target, such as the home plate. The grid also includes lines that intersect the reference lines for easy measurement of the distance from the reference point toward the target. The mat may also include means behind the reference point for mounting an adjustable pitching rubber. The analyzer can also be used for batting practice and in training for improvement in other sports such as golf for determining a proper stance.

7 Claims, 1 Drawing Sheet

STRIDE ANALYZER AND TRAINER

BACKGROUND OF THE INVENTION

The sports of baseball and softball have been played and enjoyed for many, many years. These are probably the most popular of sports from both the participant and spectator standpoints.

In both baseball and softball, pitching is probably the most important position on the team. Since a pitched ball requires anticipation and quick reflexes from batters, the ability to react to balls pitched at high velocities from short distances is the key to successful hitting. Therefore, regardless of the talents and abilities of the other players on a team, if a pitcher is weak, it will be difficult for that team to be successful in winning. Proper mechanics are the key to producing optimal speed and accuracy in pitching a ball, and successful pitchers therefore must be trained and practice the proper techniques in order to sharpen their ability to deliver the ball with both speed and accuracy into the strike zone.

Research has shown that in order to achieve maximum velocity of a pitched ball, it is necessary to produce a transfer of angular momentum by movement of the pitcher's legs, pelvis, trunk, shoulder, arm and wrist in a proper sequential order. Research has also been conducted to determine the differences that occur in the pitcher's stride length and ball velocity when a pitcher changes his or her stride angle. This is important because if the proper sequence and techniques are not used, velocity of the thrown ball can be lost and injury may result to the pitcher. It is therefore important in developing and improving a pitcher's ability to throw, that the proper stride length and stride angle be used in the throwing motion in order to produce the maximum transfer of angular momentum. This proper transfer of angular momentum is also the key to hitting a ball, be it a softball, hardball or golf ball. There is, however, not available at the present time any simple and accurate way to measure an individual's stride length and stride angle so that the proper transfer of angular momentum can be determined and used to improve the individual's techniques.

SUMMARY OF THE INVENTION

The invention is for an analyzer primarily for determining a ball pitcher's stride angle and stride length. The stride analyzer is comprised of a ground or floor mat with a grid imprinted on it. The grid has a reference point from which reference lines extend forwardly and outwardly at predetermined angles toward the target, such as the home plate. The grid also includes a plurality of intersecting lines along the reference lines for easy measurement of the distance from the reference point toward the target. The mat also includes a series of spaced apart holes behind the reference point and extending transversely to the line from the reference point to the target. These holes provide for adjustable mounting of a pitching rubber. The analyzer of the invention can also be used for batting practice and in training for improvement in other sports such as golf where the pitching rubber containing holes in the top of it for the placement of golf tees. The golfer can then use the grid to determine a proper stance.

DESCRIPTION OF THE PREFERRED EMBODIMENT OF THE INVENTION

Figure 1:
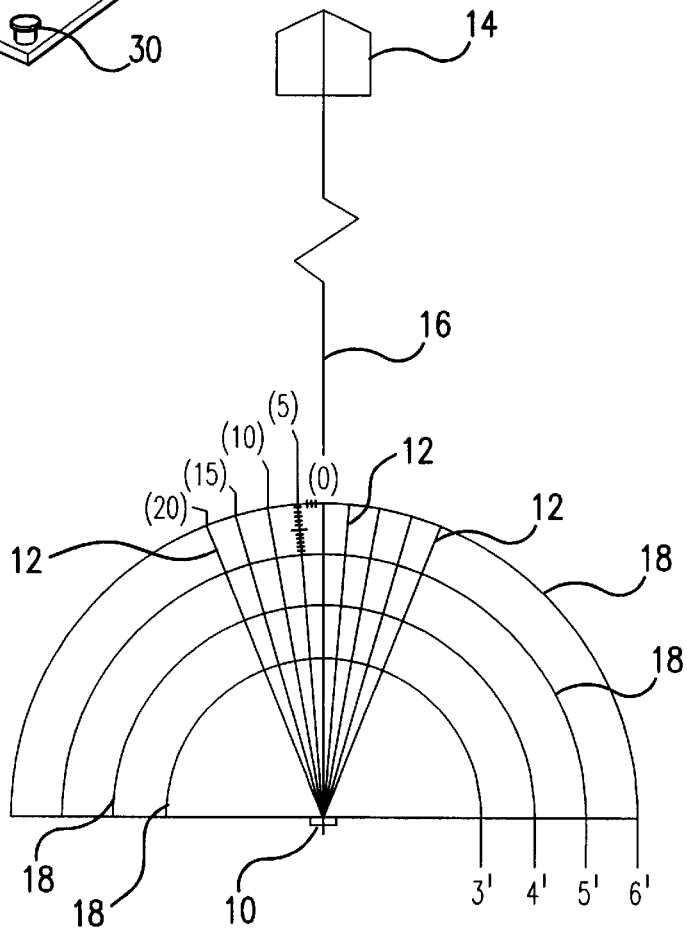
FIG. 1 is a plan view illustrating the pitching grid of the invention in relation to the target.

Referring to FIG. 1 of the drawings, there is illustrated a preferred grid utilizing the principles of the invention. The grid has a reference point 10 from which a plurality of reference lines 12 extend outwardly toward a target 14 at predetermined angles. The angles between the reference lines 12 can be any desired amount from a "0" reference line 16 which is on a straight line from the reference point 10 to the target 14. If the stride analyzer of the invention is used for baseball or softball pitching, the target 14 is of course home plate. As further illustrated in FIG. 1, concentric arc cross-reference lines 18 extend across the reference lines 12 at predetermined spaced intervals, such as every foot. If desired, additional cross-reference lines 18 can be imprinted on the grid for more accurate measurement.

Figure 2:
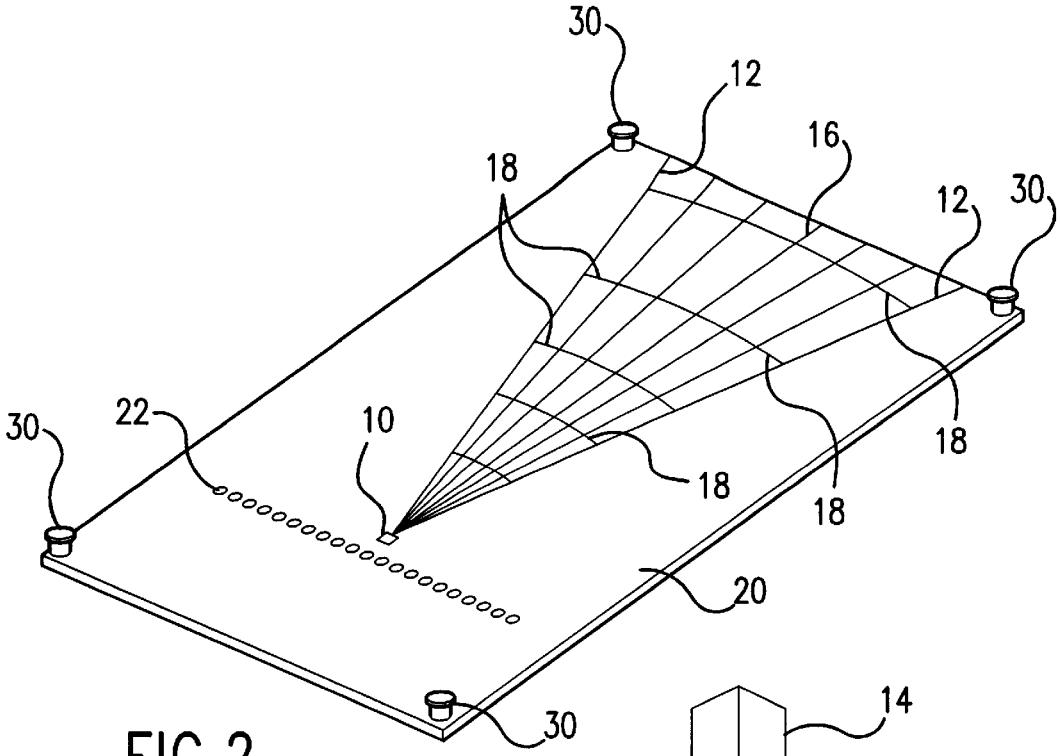
FIG. 2 is a perspective view of a mat constructed according to the principles of the invention.
Figure 3:
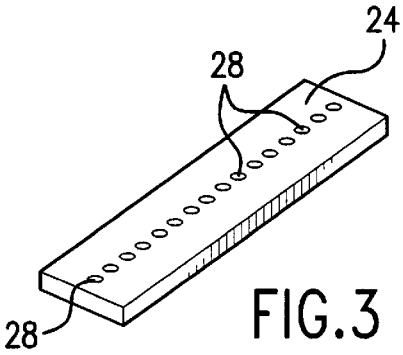
FIG. 3 is a perspective view of the removable pitching rubber used in connection with the mat.
Figure 4:
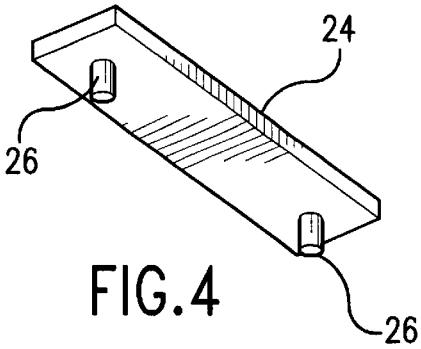
FIG. 4 is a perspective view of the lower surface of the pitching rubber.

Referring now to FIG. 2, the grid is shown being imprinted upon a ground or floor mat 20. This mat is preferably made of a flexible and durable material such as rubber so that it can be easily transported and placed in a desired location for use. Also, the mat should be of a material that has a relatively high friction to prevent the user from slipping. Ideally, the mat is approximately ten feet in length and five feet wide. As illustrated in FIG. 2, the mat includes a plurality of holes 22 extending along a straight line rearwardly of the reference point 10 and transversely to the "0" angle reference line 16. Preferably, the openings 22 are equally spaced apart so as to receive a pitching rubber 24 which is shown in FIGS. 3 and 4. The pitching rubber 24 has extending from its lower surface a pair of mounting pins 26 sized to be received in the openings 22 of the mat 20. This permits the pitching rubber to be positioned at any desired location along the line of the openings 22. The pitching rubber 24 also preferably contains a plurality of golf tee placement holes 28 if the analyzer of the invention is also used to assist golfers as more fully described hereinafter.

When the invention is used as a training aid for pitching a ball, the pitching rubber 24 is positioned in the desired position along the lines of the openings 22 in the mat 20. The pivot foot (right foot of a right-handed pitcher or left foot of a left-handed pitcher) is placed on the front edge of the pitching rubber so that great toe of the pivot foot is positioned at the reference point 10. The other foot is the "stride foot." The "stride length" is the distance between the reference point 10 on the mat 20 and the distal end of the great toe of the stride foot at the time of contact of the stride foot with the mat 20 during the throwing motion. The "stride angle" is the angle measured along a line from the reference point 10 on the mat 20 to the distal end of the great toe of the stride foot during the pitcher's normal stride. Research by S. L. Werner[1] has shown that to produce the maximum transfer of angular momentum and reduce shoulder distraction force during the pitching of a softball, the stride length should be 80–100% of the pitcher's height. In pitching a baseball, the stride length should be 70–80% of the pitcher's height.[2] Thus, an individual using the analyzer of the invention can easily determine his or her stride length and locate it on the mat 20 using the cross reference lines 18. For each pitch thrown during practice, the stride length can be measured and the necessary adjustments made until the proper stride length is consistently achieved. The pitcher's stride angle is ideally as close to the "0" line 16 as possible, and using the mat 20, the pitcher can determine his or her stride angle and adjust the throwing motion until the ideal stride angle is achieved. In order to measure progress, the velocity of pitches can be measured using a suitable device such as a radar gun and accuracy can be visually observed. Thus, by using the stride analyzer of the invention, the proper stride for a particular individual can be measured and used to correct any improper motions in the transfer of angular momentum. Corrections can be made immediately, and with immediate feedback from use of the analyzer of the invention, the pitcher can practice the proper stride length and angle and develop an accurate, consistent motion which will be programmed into the pitcher's muscle memory.

[1] Report to the Coaches: Softball Pitching at the 1996 Olympic Games, (1997) S. Werner, T. Murray, M. Levy, S. Smith, K. Plancher and R. Hawkins.

[2] Biomechanics of Overhand Throwing with Implications for Injuries, Sports Medicine, 21(6), 421–437(1996), G. Fleisig, S. Barrentine, R. Escamillaand J. Andrews. Biomechanics of Pitching With Emphasis Upon Shoulder Kinematics, *Journal of Orthopaedic and Sports Physical Therapy*, 18(2), 402–408(1993), C. Dillman, G. Fleisig and J. Andrews.

When the analyzer of the invention is used to improve hitting, the ideal stride length of the batter can be marked on the grid of the mat and the angular reference lines 12 can be used to show the hitter how far off his or her stride angle is from the "0" line 16 which is the ideal.

The stride analyzer of the invention is simple and easy to use for both players and coaches and provides immediate results and feedback for coaches and players. Thus, corrections and adjustment can be made immediately so that a user can develop the consistency necessary for the most advantageous stride angle and length and thereby improve the pitcher's or hitter's accuracy.

When the invention is used by a golfer, the pitching rubber 24 is positioned in the openings 22 and a golf tee placed in one of the holes 28. The golfer will face an imaginary target in the direction opposite to the target 14. The placement of the tee in one of the openings 28 can be varied to determine the golfer's alignment relative to the target and proper foot spacing using the reference lines 12 and 18. The proper stance can also be determined for each different club. By using the analyzer of the invention during practice on a range, a golfer can therefore develop a proper stance and ball placement to produce the best results.

It is obvious that the stride analyzer of the invention can be manufactured for use both indoors and outdoors. If desired, the mat can be provided with means, such as openings 30 to receive stakes (not shown), for anchoring it to the ground when used outdoors. The mat preferably is made of material that is not only durable but which is light enough in weight to be easily transported and which can be easily cleaned. The grid itself can be imprinted on the mat in any suitable manner so that the grid does not readily wear off. The grid of course should be of a color contrasting with the color of the mat for quick and easy reading of the stride angle and length. These colors can be coordinated with colors of a school or team where the mat is placed in use. The mat can also be used in conjunction with means for elevating it to assimilate a baseball pitching mound for baseball pitchers.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. An analyzer for measuring the stride length and stride angle of a person pitching a ball toward a target, said analyzer comprising: a mat having an upper surface and a lower surface adapted to be supported with the lower surface on the ground or floor; a reference point imprinted on the upper surface of the mat; a pitcher's rubber positioned on the upper surface of the mat behind the reference point; a zero line imprinted on the upper surface of the mat and extending from the reference point toward the target; a plurality of angular reference lines each extending outwardly from the reference point generally toward the target and at an angle from the zero line; and a plurality of cross reference lines intersecting the angular reference lines at spaced intervals outwardly from the reference point.

2. The analyzer of claim 1 in which the mat has a plurality of spaced apart openings in the upper surface of the mat which openings extend generally transversely across the mat behind the reference point.

3. The analyzer of claim 2 in which the pitching rubber contains a plurality of holes adapted for the insertion of golf tees, whereby the analyzer can be used to determine the proper stance of a golfer when faced away from the target.

4. The analyzer of claim 1 in which the mat is made of a durable non-slip material that is also sufficiently flexible to provide for ease of movement of the mat from place to place.

5. The analyzer of claim 4 in which the mat is provided with means for securing the mat to the ground.

6. The analyzer of claim 5 in which the mat is generally rectangular in shape and is provided with a hole near each corner which openings extend through the mat from its upper surface to the lower surface and are adapted to receive stakes to secure the mat to the ground.

7. An analyzer for measuring the stride length and stride angle of a person throwing or hitting a ball toward a target, said analyzer comprising: a mat having an upper surface and a lower surface adapted to be supported with the lower surface on the ground or floor; a reference point imprinted on the upper surface of the mat; a zero line imprinted on the upper surface of the mat and extending from the reference point toward the target; a plurality of angular reference lines each extending outwardly from the reference point generally toward the target and at an angle from the zero line; and a plurality of cross reference lines intersecting the angular reference lines at spaced intervals outwardly from the reference point; the angular reference lines being spaced apart at equal predetermined intervals, and the cross reference lines being equally spaced concentric lines that extend across and between the angular reference lines at predetermined intervals.

* * * * *